United States Patent [19]

Hyosu et al.

[11] Patent Number: 4,845,007

[45] Date of Patent: Jul. 4, 1989

[54] PROCESS FOR PRODUCING TONER THROUGH SUSPENSION POLYMERIZATION

[75] Inventors: Yoshihiko Hyosu, Machida; Hiromi Mori, Yokohama; Eiichi Imai, Narashino, all of Japan

[73] Assignee: Canon Kabushiki Kaisha, Tokyo, Japan

[21] Appl. No.: 945,700

[22] Filed: Dec. 23, 1986

[30] Foreign Application Priority Data

Dec. 26, 1985 [JP] Japan ..... 60-292131

[51] Int. Cl.[4] ..... G03G 9/06

[52] U.S. Cl. ..... 430/137; 430/110

[58] Field of Search ..... 430/110, 137; 524/457, 524/458, 459, 460

[56] References Cited

U.S. PATENT DOCUMENTS 4,401,742 8/1983 Chiang ..... 430/137
4,592,990 6/1986 Takagi et al. ..... 430/137
4,601,968 7/1986 Hyosu ..... 430/137
4,609,607 9/1986 Takagi et al. ..... 430/106.6
4,652,508 3/1987 Ober et al. ..... 430/110

OTHER PUBLICATIONS

Research Disclosures, No. 100 (1972) 54:6.

*Primary Examiner*—John L. Goodrow
*Attorney, Agent, or Firm*—Fitzpatrick, Cella, Harper & Scinto

[57] ABSTRACT

A dispersion stabilizer having a nitrogen-containing organic group and a water-soluble acidic substance are added to an aqueous medium. Into the aqueous medium, a monomer composition comprising at least a polymerizable monomer, an anionic polymer, a polymerization initiator and a colorant is added and dispersed therein into a prescribed particle size. The particles of the monomer composition are subjected to suspension polymerization. The resultant toner is caused to have a sharp particle size distribution and an improved anti-blocking property because of the combined effects of the dispersion stabilizer and the acidic substance contained in the aqueous medium and the anionic polymer contained in the monomer composition.

31 Claims, No Drawings

PROCESS FOR PRODUCING TONER THROUGH SUSPENSION POLYMERIZATION

FIELD OF THE INVENTION AND RELATED ART

The present invention relates to a process for producing a toner (for use in development of electrostatic latent images) to provide visual images through suspension polymerization.

Conventionally, toners for development of electrostatic charges have been manufactured by fusion-mixing colorants and other additives into thermoplastic resins to be dispersed uniformly therein, followed by pulverization and classification into desired particle sizes by means of a micropulverizer and a classifier. Such preparation method is capable of producing excellent toners but is accompanied with potential problems arising from the pulverization step. As for a toner produced through the pulverization process, the material therefor is required to be sufficiently fragile so as to be readily pulverized to some extent. However, too fragile a material is pulverized beyond any resonable extent, and so it is necessary to separate an excessively fine powder portion in order to obtain a toner with an appropriate particle size distribution, whereby production costs increase. Moreover, the toner can be further pulverized in a developing apparatus of a copying machine in some cases. Further, in a case where a low-melting point material is used in order to improve a heat fixability or a pressure-fixable material is used, an agglomeration phenomenon can occur in a pulverizer or classifier, precluding continuous production in some cases.

There are other requisite conditions for a toner such that it has a triboelectric charging characteristic suitable for development, that it provides excellent images, that it does not change when left standing, that it causes no coagulation (blocking), that it has an appropriate characteristic for heat fixation, heat-pressure fixation or pressure fixation, and that it causes no staining on the surface of a photosensitive member. Especially in respect of fixation, an offset phenomenon that a toner sticks onto a fixing roller and is then re-transferred onto a subsequent sheet of paper has been a problem. In order to prevent the phenomenon, application of a release agent such as silicone oil has been practiced. In recent years, however, there has been used a method wherein the offset is prevented by incorporating a polyolefin such as polypropylene or polyethylene in a toner and so none or only a reduced amount of release agent is applied on a fixing roller. However, this method still involves a problem for exhibiting a sufficient offset prevention effect for a long period. When a larger amount of a polyolefin is added or a polyolefin with a lower melting point is used in order to improve the anti-offset property for this reason, there arises a problem that agglomeration occurs in a pulverizer or a classifier, that blocking occurs because a low-melting polyolefin is exposed to the surface of a toner, or that the resultant toner is caused to have a poor fluidity to remarkably degrade the developing characteristic.

In order to overcome the problems accompanying the pulverization process, there has been proposed a process for producing a toner from a monomer composition comprising a polymerizable monomer and a colorant, through suspension polymerization.

This process has characteristics that the material used is not required to have fragility becuase no pulverization step is involved, and the resultant toner has a shape close to a sphere so as to be excellent in fluidity and excellent in triboelectric charging characteristic.

However, it is technically difficult to effect polymerization of a monomer composition by providing a system wherein particles of the monomer composition are stably suspended in an aqueous medium with little coalescence of the particles and to obtain fine polymer particles with a uniform particle size distribution.

There is a method of using a suspension stabilizer in order to prevent the coalescence of particles of a monomer composition and polymer particles which can occur with the progress of polymerization in suspension polymerization of the monomer composition in water. As the suspension stabilizer, a minimally water-soluble or substantially water-insoluble fine powdery inorganic compound or a water-soluble polymer has been used. Examples of the suspension stabilizer include minimally water-soluble salts such as $BaSO_4$, $CaSO_4$, $MgCO_3$, $BaCO_3$, $CaCO_3$ and $Ca_3(PO_4)_2$; inorganic macromolecules such as diatomaceous earth, talc, silicic acid and clay; powder of metal oxides; and water-soluble polymers such as polyvinyl alcohol, gelatin and starch.

However, even by these methods, it is difficult to obtain fine particles with a satisfactory size for a toner, i.e., a number-average particle size of 30 $\mu$m or smaller. This is because coalescence of particles of a monomer composition cannot sufficiently be prevented according to the methods of the prior art.

SUMMARY OF THE INVENTION

An object of the present invention is to provide a process for producing a toner through suspension polymerization (hereinafter sometimes referred to as a "polymerization toner"), by which the problems of the prior art as described above have been solved.

A specific object of the present invention is to provide a process for producing a polymerization toner with a sharp particle size distribution.

Another object of the present invention is to provide a polymerization toner which can exhibit an excellent anti-blocking characteristic even when it contains an anti-offset agent of a low melting point.

Another object of the present invention is to provide a polymerization toner which can be fixed at lower pressure-lower temperature conditions by means of hot-press rollers.

According to the present invention, there is provided a process for producing a toner, comprising: adding a monomer composition comprising at least a polymerizable monomer, an anionic polymer, a polymerization initiator and a colorant, into an aqueous medium to which a dispersion stabilizer having a nitrogen-containing organic group and a water-soluble acidic substance have been added; dispersing the monomer composition into particles with a prescribed particle size; and subjecting the particles of the monomer composition to suspension polymerization.

The above mentioned and other objects and features of the invention will be better understood upon consideration of the following detailed description concluding with specific examples of practice.

DETAILED DESCRIPTION OF THE INVENTION

In the present invention, a dispersion stabilizer having a nitrogen (atom)-containing organic group is added into an aqueous dispersion medium in which a monomer composition is to be dispersed and suspended. The dispersion stabilizer to be used in the present invention may be a cationic dispersion stabilizer and may be charged with $\delta\oplus$ in water. Herein, "$\delta\oplus$" means a charge which can move a particle having the $\delta\oplus$ to a $\ominus$ electrode in electrophoresis in an aqueous medium for suspension polymerization under the conditions of a distance between electrodes of 1 cm and an applied voltage of 500 V between the electrodes. The nitrogen-containing organic group may be one which is capable of forming

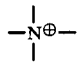

in the presence of an acidic substance in the aqueous medium. The substrate or base material of the dispersion stabilizer may be composed of inorganic fine powder or fine powder of a polymeric material. Inorganic fine powder is preferred because the post treatment after polymerization becomes easier. As the inorganic fine powder, dry-process silica powder or wet-process silica powder is preferred because of its particle size and hydrophilic characteristic. A nitrogen-containing organic group may be suitably provided onto the inorganic fine powder as the substrate by a coupling agent such as a nitrogen-containing silane coupling agent, a nitrogen-containing titanate coupling agent, or a nitrogen-containing zircoaluminate coupling agent.

Examples of the nitrogen-containing silane coupling agent include those having primary to quaternary amino group and those having a nitrogen-containing aromatic ring. In this regard, one that extremely lowers the hydrophilic characteristic of the substrate inorganic fine powder is not desirable because it degrades the function of the dispersant in an aqueous dispersion medium. For this reason, silane coupling agents having a primary to quarternary amino group are preferred. Specific examples of such silane coupling agents include the following:

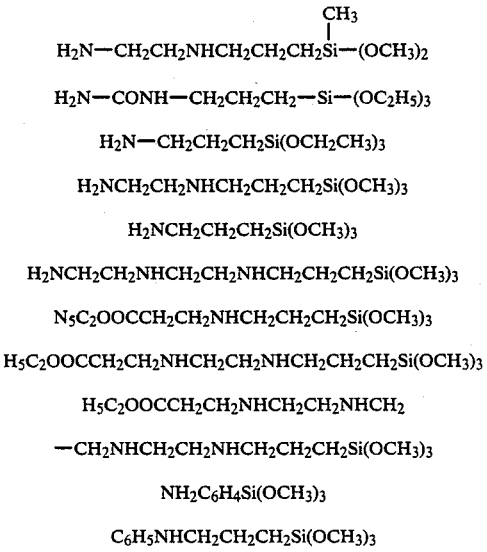

-continued

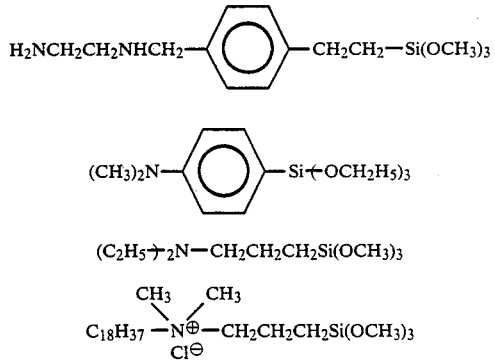

Further, polyaminoalkyltrialkoxysilane may also be used. Examples of the titanate coupling agent having an amino group may include:

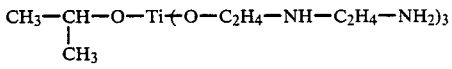

Examples of the zircoaluminate coupling agent having an amino group may include CAVCOMOD-APG (CAVEDON CHEMICAL Co., Inc.). These coupling agents may used either singly or as a mixture of two or more species.

In order to treat the inorganic fine powder with such a coupling agent, the coupling agent or a solution thereof in a volatile organic solvent may be slowly added to silica fine powder, for example, under stirring. It may also be possible to vaporize a coupling agent or a solution thereof and blow it against silica fine powder in a gaseous phase. The coupling agent may preferably be used in an amount of 0.1 to 20 wt. parts, particularly 0.5 to 10 wt. parts, with respect to 100 wt. parts of the inorganic fine powder in respect of maintaining cationic and hydrophilic characteristics.

The thus treated dispersion stabilizer can exhibit a preferred performance when a water-soluble acidic substance is present in the aqueous medium. The acidic substance has a function of cationizing the nitrogen-containing organic group and may preferably be a Broensted acid such as hydrochloric acid or acetic acid. By adding a Broensted acid, the stability of particles of the monomer composition can be further improved, coalescence of the particles is suppressed, and improvement in desirable toner characteristics may be observed. It is considered that the water-soluble acidic substance acts on the dispersion stabilizer having a nitrogen-containing organic group in the following manner.

Inorganic fine powder treated with a substance having a nitrogen-containing organic group or a coupling agent having a nitrogen-containing organic group may contain remaining unreacted hydroxyl groups. As a result, the function or effect attributable to the cationic characteristic thereof is diminished through inter-particle bonding or particle-particle bonding due to some force like a hydrogen bond acting between the amino group in the coupling agent and the hydroxyl groups in the aqueous medium. Further, the bonding between particles causes so-called secondary agglomeration, so that individual particles are prevented from sufficiently exhibiting their function. When a water-soluble acidic substance is caused to be present in such a system, the above mentioned inter-particle bonding and particle-particle bonding are removed and disintegrate the agglomerates, so that the individual particles are sufficiently suspended to improve the function and stabilize the dispersion.

Stabilization of the dispersion provides desirable effects in decreasing the time for dispersion down to a desirable particle size and also in preventing the formation of scale or fine powder polymerization byproducts. While the effects are exhibited for both an anionic monomer and an anionic polymer (inclusive of copolymer), a monomer composition containing an anionic polymer is more advantageous than a monomer composition containing no anionic polymer because of substantial absence from elution into water of the anionic substance, so that it provides better results in respects of scale prevention and, shorter dispersion time and better toner characteristics.

The anionic polymer contained in the monomer composition exerts an electrostatic attraction with the dispersion stabilizer having a nitrogen-containing organic group which is a cationic dispersant in the aqueous medium to be localized at the surface of the monomer composition particles. As a result, coalescence of the particles during the dispersion and polymerization is prevented, and the toner obtained after the polymerization is improved in negatively charging characteristic. Further, the dispersion stabilizer having a cationic characteristic according to the present invention may be improved in dispersibility in the aqueous medium through ionization due to the addition of a water-soluble acidic substance or protons ($H^+$) formed therefrom.

The water-soluble acidic substance is a substance which can generate hydrogen ions and neutralize a base to form a salt, shows acidity, and can preferably quaternarize a nitrogen-containing organic group such as an amino group. For example, an inorganic acid such as hydrochloric acid, sulfuric acid, nitric acid, and phosphoric acid, or an organic acid such as formic acid, acetic acid and lactic acid, may be used. Among these, hydrochloric acid is particularly preferred because it is a strong acid and can be easily removed after the reaction by washing with water or heating. The amount of addition of the acidic substance is adjusted so that the aqueous medium in which the treated dispersant is dispersed is caused to have a pH of 7–1, preferably 6.5–2, further preferably 6.5–3.5.

When the pH is 7 or higher, the cationization of the dispersion stabilizer becomes insufficient. When the pH is below 1, there results in an increased tendency that a magnetic material in the monomer composition is eluted and the reaction vessel and the stirrer are corroded. In order to increase the ionization of the dispersion stabilizer, it is preferred to adjust the addition amount of the water-soluble acidic substance so as to provide a difference in pH of 0.1–5.5, particularly 0.5–4.0, of the aqueous medium before and after the addition of the water-soluble acidic substance.

The anionic polymer used in the present invention is a polymer which moves to a ⊕ electrode in electrophoresis under the condition of pH 1–7. Examples thereof include homopolymers or copolymers of the following anionic monomers. For example, monomers containing a nitrile group such as acrylonitrile, methacrylonitrile, α-chloroacrylonitrile, and vinylidene cyanide; halogen-containing monomers such as vinyl chloride, vinylidene chloride, vinyl bromide, vinyl flouride, clorostyrene, dichlorostyrene, and bromostyrene; carboxyl group-containing monomers such as acrylic acid, methacrylic acid, and α-chloroacrylic acid; unsaturated dibasic acids and derivatives thereof such as maleic acid, maleic anhydride and maleic half ester; nitro group-containing monomers such as o-nitrostyrene, m-nitrostyrene, and p-nitrostyrene; monomers containing a hydroxyl group, ethylene glycol group, propylene glycol group, sulfonic acid group, phosphoric acid group or glycidyl group such as 2-acrylamide-2-methylpropanesulfonic acid, N-methylolacrylamide, 2-hydroxyethyl acrylate, 2-hydroxypropyl methacrylate, glycidyl methacrylate, polypropylene glycol monomethacrylate, tetrahydrofurfuryl methacrylate, and acid phosphoxyethyl methacrylate. Copolymers of an anionic monomer as described with one or more of the following monomers copolymerizable therewith may also be used.

For example, styrene and its derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tertbutylstyrene, p-n-hexylstyrene, p-n-octylstyrene, p-n-nonylstyrene, p-n-decylstyrene, and p-n-dodecylstyrene; ethylenically unsaturated monolefins such as ethylene, propylene, butylene, and isobutylene; halogenated vinyls such as vinyl chloride, vinylidene chloride, vinyl bromide, and vinyl fluoride; vinyl esters such as vinyl acetate, vinyl propionate, and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; derivatives of acrylic acid and methacrylic acids such as acrylonitrile, methacrylonitrile, and acrylamide. Further, polyester resins, cyclic rubber, phenol resin, phenol-modified rosin ester resin, epoxy resin, and silicone resin may also be used. Among these, cyclic rubber is especially preferred when a negatively chargeable toner is produced, because it provides a good negatively chargeable characteristic.

The anionic polymer may preferably be used in an amount of 1–30 wt. parts per 100 wt. parts of the polymerizable monomer. Below 1 wt. part, the particle size uniformization effect due to the anionic polymer is not sufficiently exhibited. Above 30 wt. parts, the viscosity of the monomer composition is too high and particulation becomes difficult. It is preferred that the anionic polymer has a weight-average molecular weight of 5,000–500,000 in view of preventing coalescence of particles during the polymerization and the anti-blocking property of the toner obtained after the polymerization.

Examples of the polymerizable monomer may include unsaturated dibasic acids and derivatives thereof such as maleic acid, maleic anhydride, and maleic acid half esters; styrene and its derivatives such as styrene, o-methylstyrene, m-methylstyrene, p-methylstyrene, p-methoxystyrene, p-phenylstyrene, p-chlorostyrene, 3,4-dichlorostyrene, bromostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, o-nitrostyrene, m-nitrostyrene, and p-nitrostyrene; ethylenically unsaturated monoolefins such as ethylene, propylene, butylene, and isobutylene; halogenated vinyls such as vinyl chloride, vinylidene chloride, vinyl bromide, and vinyl fluoride; vinyl esters such as vinyl acetate, vinyl propionate, vinyl benzoate; α-methylene-aliphatic monocarboxylic acid esters such as methyl methacrylate, ethyl methacrylate; 2-hydroxyethyl methacrylate, propyl methacrylate, 2-hydroxypropyl methacrylate, n-butyl methacrylate, isobutyl methacrylate, n-octyl methacrylate, dodecyl methacrylate, 2-ethylhexyl methacrylate, stearyl methacrylate, phenyl methacrylate, glycidyl methacrylate, polypropylene glycol monomethacrylate, tetrahydrofurfuryl methacrylate, acid phosphoxyethyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone; vinyl hexyl ketone, and methyl isopropenyl ketone; N-vinyl compounds such as N-vinylpyrrole, N-vinylcarbazole, N-vinylindole, and N-vinylpyrrolidone; vinyl naphthalenes; derivatiees of acrylic acid or methacrylic acid such as acrylonitrile, methacrylonitrile, α-chloroacrylonitrile, acrylamide, N-methylolacrylamide, and 2-acrylamide-2-methylpropanesulfonic acid. Among these, styrene; styrene having a substituent; combination of styrene and acrylic acid; combination of styrene and methacrylic acid; or combination of styrene and an acrylic acid ester; is particularly preferred as a polymerizable monomer in view of the developing characteristic and the durability of the resultant polymerization toner.

It is also possible to have a crosslinking agent as exemplified below in the polymerization system to produce a crosslinked polymer.

Examples of the crosslinking agent may appropriately include: divinylbenzene, divinylnaphthalene, divinyl ether, divinyl sulfone, diethylene glycol dimethacrylate, triethylene glycol dimethacrylate, ethylene glycol dimethacrylate, polyethylene glycol dimethacrylate, diethylene glycol diacrylate, triethylene glycol diacrylate, 1,3-butylene glycol dimethacrylate, 1,6-hexane glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. Among these, diethylene glycol dimethacrylate, triethylene glycol dimethacrylate and ethylene glycol dimethacrylate are preferred in view of the anti-offset characteristic and hot-press fixability.

If such a crosslinking agent is used in an excessive amount, the resultant toner particles lose fusibility to show a poor fixability. If the amount is too small, properties such as anti-offset characteristic, anti-blocking characteristic and durability become poor, so that it becomes difficult to prevent the offset phenomenon wherein, in hot-press roller fixation, a portion of a toner is not completely fixed onto paper but fixed onto a roller surface, and is then re-transferred onto a subsequent sheet of paper. For these reasons, the amount of use of the crosslinking agent may suitably be 0.001–15 wt. %, preferably 0.1–10 wt. %, of the total amount of the monomer.

The polymerization of the monomer may be effected by using a polymerization initiator such as azobisisobutyronitrile (AIBN), benzoyl peroxide, methyl ethyl ketone peroxide, isopropyl peroxycarbonate, cumene hydroperoxide, 2,4-dichlorobenzoyl peroxide, lauroyl peroxide, azobis-(2,4-dimethylvaleronitrile), and a mixture of these. The initiator is generally used in an amount of about 0.5–5 wt. % of the monomer.

It is preferable to add a release agent to a toner in order to improve the fixability and the offset characteristic of the toner. The release agent used in the present invention may be a substance which reduces a friction between the fixing roller and the toner at the time of fixation or improves the fluidity at the time of melting. Examples of the release agent include polyethylene fluoride, fluorinated resin, fluorinated carbon oil, silicone oil, low-molecular weight polyethylene, low-molecular weight polypropylene, and long chain compounds having carbon chains. The release agent may preferably be used in an amount of 0.5–15. wt. parts per 100 wt. parts of the monomer. Below 0.5 wt. parts, the effect is not sufficient, while above 15 wt. parts, there increases a tendency that the anti-blocking characteristic and the fixation characteristic are lowered.

Examples of the long chain compounds having carbon chains include hydrocarbons, chlorinated hydrocarbons, fluorinated hydrocarbons; aliphatic acids, aliphatic acid esters, aliphatic acid metal salts; aliphatic alcohols; polyhydric alcohols; amides; and bisamides. These materials are commercially available as a single substance or a mixture. These substances are generally known as paraffin wax, microcrystalline wax, montan wax, ceresine wax, ozocerite, carnauba wax, rice wax, shellac wax, sasol wax, metallic soap, amide wax, and lubricant. Examples of commercially available products include the following: paraffin Wax (Nihon Sekiyu K.K.), Paraffin Wax (Nihon Seiro K.K.), Microwax (Nihon Sekiyu K.K.), Microcrystalline Wax (Nihon Seiro K.K.), Hoechst Wax (Hoechst A. G.), Diamond Wax (Shinnihon Rika K. K.), Santite (Seiko Kagaku K. K.), and Panasete (Nihon Yushi K. K.).

Representative grades of paraffin wax include those shown in the following Tables 1 and 2.

TABLE 1

Paraffin wax and Microwax (produced by Nipoon Sekiyu K.K.)

| Trade Name | m.p. °C. |
|---|---|
| Nisseki No. 1 Candle wax | 59.7 |
| Nisseki No. 2 Candle wax | 62.0 |
| 125° Paraffin | 54.3 |
| 130° Paraffin | 56.5 |
| 135° Paraffin | 59.7 |
| 140° Paraffin | 61.9 |
| 145° Paraffin | 63.2 |
| 125° FD Paraffin | 53.8 |
| Paraffin wax (M) | 54.1 |
| 125° Special paraffin | 54.2 |
| Nisseki Microwax 155 | 70.0 |
| Nisseki Microwax 180 | 83.6 |

TABLE 2

| Paraffin wax (produced by Nippon Seiro K.K.) | | | | |
|---|---|---|---|---|
| Trade Name | m.p. °C. | Trade Name | m.p. °C. | Trade Name |
| 155 | 70 | SP-0145 | 62 | NCW-5 |
| 150 | 66 | SP-1035 | 58 | NCW-10 |
| 140 | 60 | SP-1030 | 56 | NCW-35 |
| 135 | 58 | SP-3040 | 63 | NCW-38 |
| 130 | 55 | SP-3035 | 60 | NCW-40 |
| 125 | 53 | SP-3030 | 57 | NCW-42 |
| 120 | 50 | FR-0120 | 50 | NCW-45 |
| 115 | 47 | | | NCW-50 |
| | | | | NCW-55 |
| | | | | NCW-60 |
| | | | | NCW-110 |
| | | | | NCW-120 |
| | | | | NCW-125 |

As a monomer readily soluble in water simultaneously causes emulsion polymerization to contaminate the resultant suspension polymerizate with finer emulsion polymer particles, it is effective to add a water-soluble polymerization inhibitor such as a metal salt to prevent the emulsion polymerization in the aqueous phase. It is also possible to add a salt such as NaCl, KCl or $Na_2SO_4$ in order to decrease the solubility of a readily water-soluble monomer in water.

After the completion of the reaction, the dispersion stabilizer attached to the produced toner particles may be removed by dissolution by washing with water, an alkaline aqueous solution or an acidic aqueous solution in a known manner. Especially in a case of treated colloidal silica, after the reaction, the toner particles formed are charged in a prescribed concentration of an alkaline aqueous solution or a prescribed weight of alkali is charged into the reaction vessel, and the mixture is stirred for 3–24 hours at room temperature to 40° C., followed by filtration, sufficient washing with water and drying to obtain a toner.

In the suspension polymerization, a monomer composition obtained by uniformly dissolving or dispersing a polymerization initiator, a colorant, a monomer, an anionic polymer and other optional additives, may be dispersed in an aqueous phase containing a dispersion stabilizer and an acidic substance by means of an ordinary stirrer, homomixer or homogenizer. Preferably, the speed and time for stirring may be adjusted so that the droplets of the monomer composition have the desired toner particle size of generally 30 μm or below, and after that, the stirring is effected to such an extent that the dispersion state is substantially maintained as such while preventing the sedimentation of the particles. The polymerization temperature may be set to a temperature of 50° C. or above, generally 70°–90° C. The suspension polymerization reaction may suitably be conducted for a period of 0.5–24 hours. After the completion of the reaction, the resultant toner particles are washed, recovered by an appropriate method such as filtration, decantation and centrifugation, and dried.

Examples of the colorant may include dyes or pigments such as carbon black, iron black, phthalocyanine blue, ultramarine, quinacridone, and benzidine yellow. The colorant may be ordinarily used in an amount of 0.5–20 wt. parts per 100 wt. parts of the monomer.

In a case of providing a magnetic toner by incorporating magnetic powder, a substance magnetizable when placed in a magnetic field, may be used as the magnetic material. The magnetic powder comprise powder of a ferromagnetic metal such as iron, cobalt and nickel, or an alloy or a compound thereof such as magnetite, hematite and ferrite. The magnetic powder may also be a colorant. The magnetic powder may be added in such an amount as to constitute 15–70 wt. % of the toner. It is possible that the magnetic powder may be coated with a resin or an appropriate treating agent. It is also possible to add a known additive for dispersing magnetic powder. A magnetic material (powder) showing a hydrophobicity through treatment with a resin or an appropriate treating agent may be particularly preferred.

A charge controller and a fluidity improver may be added as desired in the monomer composition in order to improve the charge controllability and fluidity of the polymerization toner. The charge controller and the fluidity improver may also be mixed with (externally added to) the toner particles. The charge controller may for example be a metal-containing dye or nigrosine. The fluidity improver may for example be colloidal silica or an aliphatic acid metal salt. It is also possible to incorporate a filler such as calcium carbonate or fine powdery silica in an amount of 0.5–20 wt. % in the toner for the purpose of extension. Further, it is possible to add a fluidity improver such as polytetrafluoroethylene fine powder in order to disintegrate the agglomerate of the toner particles and improve the fluidity.

The developing method using the toner produced as described above may be any of the known methods including the two-component developing methods such as the cascade method, the magnetic brush method, and the microtoning method; the one-component developing methods using a toner containing a magnetic material such as the electroconductive one-component developing method, the insulating one-component developing method and the jumping developing method; the powder cloud method and the fur brush method; and the non-magnetic one-component developing method wherein the toner is carried on a toner-carrying member to be conveyed to a developing position and subjected to developing thereat.

Hereinbelow, the present invention will be explained by way of examples.

EXAMPLE 1

| | |
|---|---|
| Styrene monomer | 160 g |
| n-Butyl methacrylate monomer | 40 g |
| Styrene-acrylonitrile-methacrylic acid copolymer (St./AT/MAA = 85/15/5, $\overline{Mw}$ = 50,000) | 10 g |
| Paraffin wax 155° F. | 8 g |
| Lipophilized magnetic material (average particle size: 0.3 μ) | 120 g |

The above ingredients were heated at 70° C. to dissolve the copolymer in the styrene monomer and uniformly disperse the insoluble. Thereafter, the monomer composition was mixed for about 5 minutes while being heated at about 70° C. in a vessel provided with a high-shearing force mixer (TK homomixer, mfd. by Tokushu Kika Kogyo K.K.). Then, 10 g of azobisisobutyronitrile was dissolved therein.

Separately, 10 g of silica (Aerosil #200) treated with 5% of γ-aminopropylethoxysilane was dispersed in 1000 ml of water, and 20 g of 0.1N-HCl was added thereto. The aqueous phase showed pH 7.4 before the addition of 0.1N-HCl and pH 6 after the addition, according to measurement by use of pH test paper. Then, while heating the aqueous phase at 70° C., the above monomer composition was charged thereinto under stirring by means of the TK homomixer, and the system was further stirred at 8000 rpm for about 30 minutes. Then, the system was stirred by means of a paddle blade stirrer to complete the polymerization. The dispersant was removed by adding sodium hydroxide into the aqueous phase, and the remaining particles were subjected to filtration, washing with water, and drying to obtain a toner. Fine powder portion (scale) was removed by passing the toner through a 200-mesh sieve and measured to be below 1%. The resultant toner showed a volume-average particle size of 11.5 μm. Hydrophobic silica (R-972) in an amount of 0.4 g was added to and mixed with 100 g of the toner to form a developer. The developer was used for image formation by means of an electrophotographic copier (NP-270RE, mfd. by Canon K.K.), whereby sharp images were obtained. In continuous image formation, no practical deterioration in images was observed, and sharp images of high density were continually obtained. Even under high temperature-high humidity environmental conditions, no practical problem was observed as compared with the image formation under the normal temperature-normal humidity conditions to obtain a high image density.

10 g of the toner produced above was charged in a 100 ml-polyethylene container and left standing for 3 days under the environmental conditions of a temperature of 50° C. and a relative humidity of 60±5%, whereby no agglomeration block to such an extent as to exert ill effects to developing was observed, and the toner was found to have an excellent anti-blocking characteristic. This is considered because the styrene-acrylonitrile-methacrylic acid copolymer having a $\delta\ominus$ charge was electrostatically attracted by the $\delta\oplus$ charge of the amino group present at the surface of the silica used as the dispersion stabilizer to be localized at the surface of the toner particles.

COMPARATIVE EXAMPLE 1

The suspension polymerization was conducted in the same manner as in Example 1 except that the 20 g of 0.1N-HCl was not added into the aqueous phase. In order to obtain the same particle size as in Example 1, 45 minutes of stirring with a homomixer was utilized, which was, as previously, rotating at 8000 rpm. Fine scale portion was removed by a 200-mesh sieve and measured to be 4 wt. %.

10 g of the resultant toner was charged in a 100 ml-polyethylene container and left standing for 3 days under the environmental conditions of a temperature of 50° C. and a relative humidity of 60±5%, whereby agglomeration blocks of 1–5 mm were found to be formed. This is considered because the electrostatic attraction exerted by the amino group on the silica surface was weakened and the degree of localization of the styrene-acrylonitrilemethacrylic acid copolymer at the toner particle surfaces was lowered so that the anti-blocking property was deteriorated as compared with that in Example 1.

At the same time, when the developer including the toner was subjected to image formation by means of the NP-270RE copier, sharp images were obtained at the initial stage, whereas fog increased gradually during continuous image formation. Further, under the environmental conditions of high temperature and high humidity, fog was noticeably observed from the initial stage.

EXAMPLE 2

| | |
|---|---|
| Styrene monomer | 160 g |
| 2-Ethylhexyl methacrylate monomer | 40 g |
| Cyclic rubber (CK-450, mfd. by Hoechst A.G.) | 10 g |
| Paraffin wax 155° F. | 8 g |
| Magnetite (BL-250, Titan Kogyo K.K.) | 120 g |
| Stearic acid | 2 g |

The above ingredients were heated at 80° C. to effect dissolution and dispersion. The monomer composition was subjected to mixing at 60° C. for about 10 minutes in a vessel provided with a TK homomixer. Then, 10 g of azobis-(2,4-dimethylvaleronitrile) was dissolved therein.

Separately, 10 g of silica (Aerosil #200) treated with 5 wt. % of γ-aminopropylmethoxysilane was dispersed in 1000 ml of water, and 19 g of 0.1N-HCl was added thereto. The measurement with pH test paper showed pH 7.4 before the addition and pH about 6.3 after the addition. Then, the polymerization was conducted at 60° C. to obtain a toner. The amount of scale contained in the toner was below 1%.

Image formation was conducted similarly as in Example 1, whereby good images were obtained.

EXAMPLE 3

A toner was obtained in the same manner as in Example 1 except that 120 g of the lipophilized magnetic material was replaced by 10 g of phthalocyanine blue. The content of the scale was below 1%. The toner was mixed with iron powder carrier (EFV 250/400, mfd. by Nihon Teppun K.K.) so as to obtain a developer having a toner content of 10 wt. %, which was then subjected to image formation by means of a copier (NP-5500, mfd. by Canon K.K.), whereby good images were obtained.

EXAMPLE 4

| | |
|---|---|
| Styrene | 160 g |
| n-Butyl methacrylate | 40 g |
| Methacrylic acid | 2 g |
| Cyclic rubber | 5 g |
| Phthalocyanine Blue | 10 g |
| Azobisisobutylonitrile | 10 g |

A toner was prepared in the same manner as in Example 3 by using the above composition. The resultant polymerization toner showed a good negative chargeability and was excellent in anti-blocking characteristic.

As described hereinabove, the polymerization toner produced according to the present invention provides sharp images of high density and also provides images of high quality even under continuous use and under enrivonmental conditions of high temperature and high humidity. Further, the toner has a sharp particle size distribution and is also excellent in anti-blocking characteristic.

What is claimed is:

1. A process for producing a toner, comprising the steps of:

adding a monomer composition comprising at least a polymerizable monomer, an anionic polymer, a polymerization initiator and a colorant into an aqueous medium to which a dispersion stabilizer having a nitrogen-containing organic group and a water-soluble acidic substance have been added, dispersing the monomer composition into particles of a prescribed particle size in the aqueous medium, subjecting the particles of the monomer composition to suspension polymerization to produce toner particles to which said dispersion stabilizer is attached, and removing the dispersion stabilizer which is attached to the suspension-polymerized toner particles.

2. A process according to claim 1, wherein said water-soluble acidic substance is a Broensted acid.

3. A process according to claim 2, wherein said water-soluble substance is an inorganic acid selected from the group consisting of hydrochloric acid, sulfuric acid, nitric acid, and phosphoric acid.

4. A process according to claim 2, wherein said water-soluble acidic substance is formic acid or lactic acid.

5. A process according to claim 1, wherein said dispersion stabilizer is charged with $\delta\oplus$ in the aqueous medium.

6. A process according to claim 5, wherein said dispersion stabilizer has a

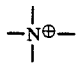

ion in the aqueous medium.

7. A process according to claim 6, wherein said dispersion stabilizer comprises inorganic powder provided with an organic group comprising an amino group.

8. A process according to claim 7, wherein said dispersion stabilizer comprises dry-process silica or wet-process silica treated with a coupling agent having a primary to quaternary amino group.

9. A process according to claim 1, wherein said aqueous medium shows a pH of 7 to 1.

10. A process according to claim 9, wherein said aqueous medium shows a pH of 6.5 to 2.

11. A process according to claim 10, wherein said aqueous medium shows a pH of 6.5 to 3.5.

12. A process according to claim 1, wherein said anionic polymer is a polymer capable of moving to a $\oplus$ electrode in electrophoresis under pH 1 to 7.

13. A process according to claim 1, wherein said monomer composition comprises 1–30 wt. parts of the anionic polymer per 100 wt. parts of the polymerizable monomer.

14. A process according to claim 1, wherein said anionic polymer has a weight-average molecular weight of 5,000–500,000.

15. A process according to claim 1, wherein said polymerizable monomer is a vinyl monomer having a reactive —C=C— group.

16. A process according to claim 1, wherein said polymerizable monomer comprises a vinyl monomer selected from the group consisting of styrene, acrylic acid, alkyl acrylate ester, methacrylic acid, alkyl methacrylate ester, and mixtures of these.

17. A process according to claim 1, wherein said monomer composition further comprises a crosslinking agent.

18. A process according to claim 17, wherein said crosslinking agent is a monomer having at least two vinyl groups.

19. A process according to claim 18, wherein said monomer composition contains 0.001–15 wt. % of the crosslinking agent based on the total amount of the polymerizable monomer.

20. A process according to claim 19, wherein said monomer composition contains 0.1–10 wt. % of the crosslinking agent based on the total amount of the polymerizable monomer.

21. A process according to claim 20, wherein the suspension polymerization is carried out at a temperature of 50° C. or higher.

22. A process according to claim 21, wherein the suspension polymerization is carried out at a temperature of 70°–90° C.

23. A process according to claim 7, wherein the dispersion stabilizer attached to the toner particles is removed by washing with water.

24. A process according to claim 7, wherein the dispersion stabilizer attached to the toner particles is removed by washing with an alkaline aqueous solution.

25. A process according to claim 7, wherein the dispersion stabilizer attached to the toner particles is removed by washing with an acidic aqueous solution.

26. A process according to claim 24, wherein the dispersion stabilizer comprises colloidal silica having a nitrogen-containing organic group.

27. A process according to claim 1, wherein said monomer composition further comprises a release agent.

28. A process according to claim 27, wherein said release agent is selected from the group consisting of polyethylene fluoride, fluorinated resin, fluorinated carbon oil, silicone oil, low-molecular weight polyethylene, low-molecular weight polypropylene, and long chain carbon compounds.

29. A process according to claim 28, wherein said release agent is contained in an amount of 0.5–15 wt. parts per 100 wt. parts of said polymerizable monomer in said monomer composition.

30. A process according to claim 28, wherein said long chain carbon compound is selected from the group consisting of hydrocarbons, chlorinated hydrocarbons, fluorinated hydrocarbons, aliphatic acids, aliphatic acid esters, aliphatic acid metal salts, aliphatic alcohols, polyhydric alcohols, amides and disamides.

31. A process according to claim 30, wherein said long chain compound is selected from the group consisting of paraffin wax, microcrystalline wax, montan wax, ceresine wax, ozocerite, carnauba wax, rice wax, shellac wax, sasol wax, metallic soap, amide wax, and lubricant.

* * * * *

UNITED STATES PATENT AND TRADEMARK OFFICE

CERTIFICATE OF CORRECTION

PATENT NO. : 4,845,007 Page 1 of 2

DATED : July 4, 1989

INVENTOR(S) : Yoshihiko Hyosu, et al.

It is certified that error appears in the above-identified patent and that said Letters Patent is hereby corrected as shown below:

COLUMN 1:

Line 33, "precluding" should read --even precluding--.

Line 68, "becuase" should read --because--.

COLUMN 4:

Line 29, "may used" should read --may be used--.

COLUMN 5:

Line 67, "clorostyrene" should read --chlorostyrene--.

COLUMN 6:

Line 4, "maleic half" should read --maleic acid half--.

UNITED STATES PATENT AND TRADEMARK OFFICE

CERTIFICATE OF CORRECTION

PATENT NO. : 4,845,007 Page 2 of 2

DATED : July 4, 1989

INVENTOR(S) : Yoshihiko Hyosu, et al.

It is certified that error appears in the above-identified patent and that said Letters Patent is hereby corrected as shown below:

COLUMN 7:

Line 31, "derivatiees" should read --derivatives--.

COLUMN 8:

Line 45, "paraffin" should read --Paraffin--.

COLUMN 14:

Line 53, "disamides." should read --bisamides.--

Signed and Sealed this

Nineteenth Day of June, 1990

*Attest:*

HARRY F. MANBECK, JR.

*Attesting Officer*

*Commissioner of Patents and Trademarks*